US005588819A

United States Patent [19]

Wallis

[11] Patent Number: 5,588,819

[45] Date of Patent: Dec. 31, 1996

[54] COMPLIANT DRIVE FOR SCROLL MACHINE

[75] Inventor: Frank S. Wallis, Sidney, Ohio

[73] Assignee: Copeland Corporation, Sidney, Ohio

[21] Appl. No.: 490,906

[22] Filed: Jun. 16, 1995

[51] Int. Cl.[6] ..... F04C 18/04

[52] U.S. Cl. ..... 418/39; 418/55.5; 418/57; 29/888.022

[58] Field of Search ..... 418/39, 55.5, 57; 29/888.022

[56] References Cited

U.S. PATENT DOCUMENTS

| | | | |
|---|---|---|---|
| 5,017,107 | 5/1991 | Fraser, Jr. et al. | 418/55.5 |
| 5,295,813 | 3/1994 | Caillat et al. | 418/55.5 |
| 5,328,342 | 7/1994 | Ishii et al. | 418/55.5 |
| 5,342,185 | 8/1994 | Anderson | 418/55.5 |
| 5,433,589 | 7/1995 | Wada et al. | 418/55.5 |

FOREIGN PATENT DOCUMENTS

| | | | |
|---|---|---|---|
| 4128582 | 4/1992 | Japan | 418/55.5 |
| 5248371 | 9/1993 | Japan | 418/55.5 |

*Primary Examiner*—John J. Vrablik
*Attorney, Agent, or Firm*—Harness, Dickey & Pierce

[57] ABSTRACT

A scroll-type apparatus includes a radial compliant drive. The radial compliant drive is achieved by using a set of corresponding flat driving surfaces with one of the drive surfaces being located on a drive bushing and the other being located on a crankshaft. The drive bushing is provided with a pair of flat drive surfaces with each flat drive surface of the drive bushing capable of mating with the drive surface of the crankshaft in a different geometrical fashion to provide two different radial driving loads.

39 Claims, 4 Drawing Sheets

FIG. 6a.
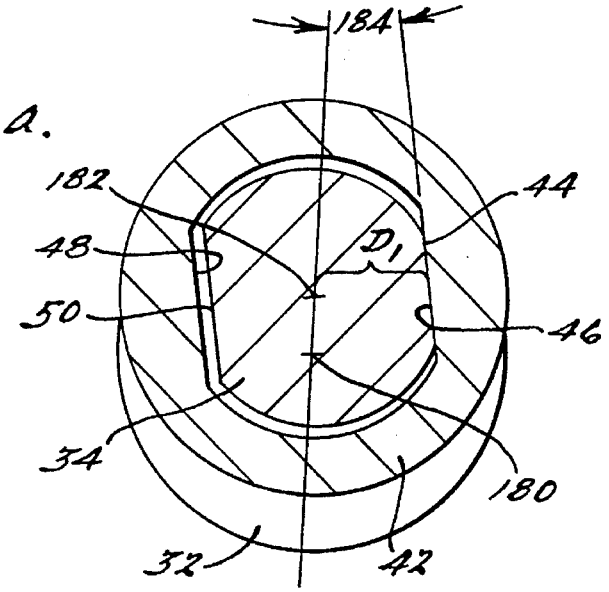
FIG. 6b.
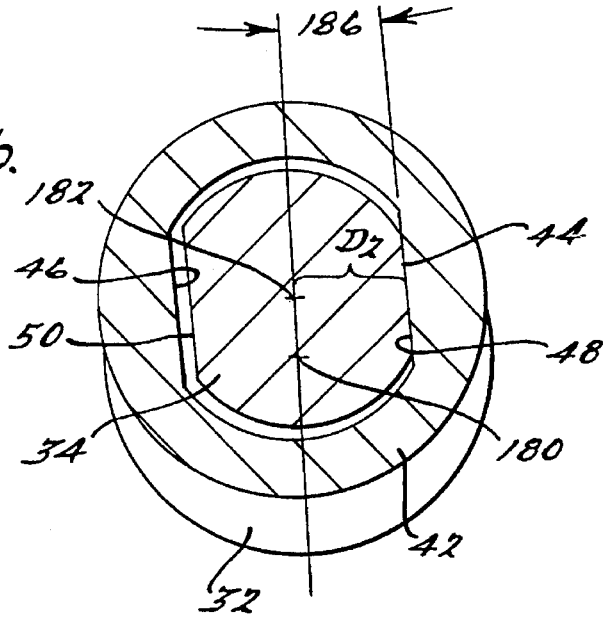
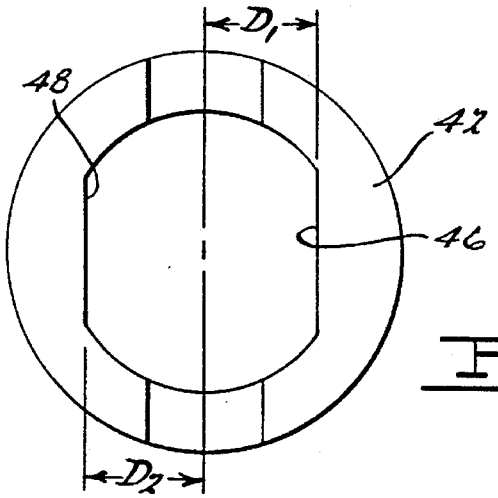
FIG. 5.

Fig. 6a.
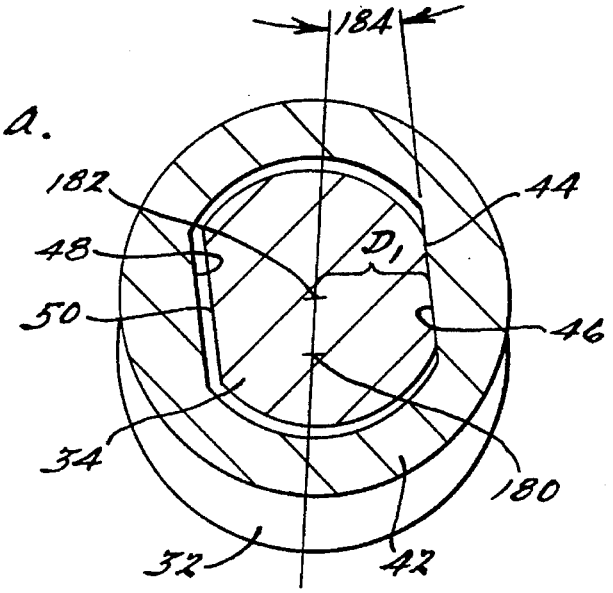
Fig. 6b.
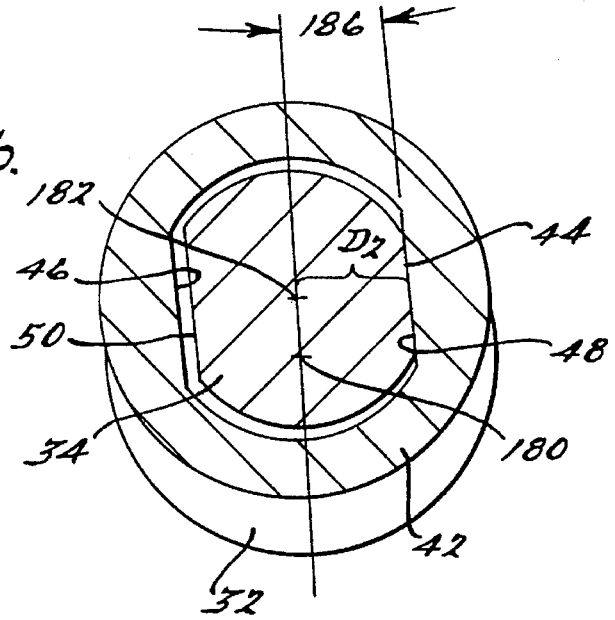
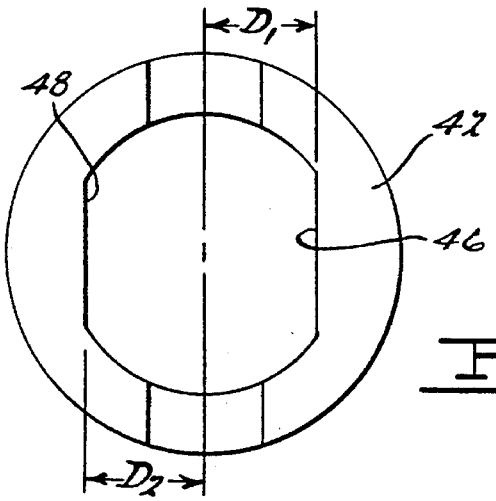
Fig. 5.

COMPLIANT DRIVE FOR SCROLL MACHINE

FIELD OF THE INVENTION

The present invention relates generally to scroll-type machinery. More particularly, the present invention relates to a scroll-type machine incorporating a drive bushing which can be located in multiple positions in order to alter the flank sealing load between the two scroll wraps.

BACKGROUND AND SUMMARY OF THE INVENTION

A class of machines exists in the art generally known as "scroll" apparatus for the displacement of various types of fluids. Such apparatus may be configured as an expander, a displacement engine, a pump, a compressor, etc., and the features of the present invention are applicable to any one of these machines. For purposes of illustration, however, the present invention is disclosed incorporated into a hermetic refrigerant compressor.

Generally speaking, a scroll apparatus comprises two spiral scroll wraps of similar configuration each mounted on a separate end plate to define a scroll member. The two scroll members are interfitted together with one of the scroll wraps being rotationally displaced approximately 180 degrees from the other. The scroll apparatus operates by orbiting one scroll member (the "orbiting scroll") with respect to the other scroll member (the "fixed scroll" or "non-orbiting scroll") to make moving line contacts between the flanks of the respective wraps, defining moving isolated crescent-shaped pockets of fluid. The spirals are commonly formed as involutes of a circle, and ideally there is no relative rotation between the scroll members during operation, i.e., the motion is purely curvilinear translation (i.e. no rotation of any line in the body). The fluid pockets carry the fluid to be handled from a first zone in the scroll apparatus where a fluid inlet is provided, to a second zone in the scroll apparatus where a fluid outlet is provided. The volume of a sealed pocket changes as it moves from the first zone to the second zone. At any one instant in time, there will be at least one pair of sealed pockets, and when there are several pairs of sealed pockets at one time, each pair will have different volumes. In a compressor, the second zone is at a higher pressure than the first zone and is physically located centrally in the scroll apparatus, the first zone being located at the outer periphery of the scroll apparatus.

The concept of a scroll-type apparatus has thus been known for some time and has been recognized as having distinct advantages. For example, scroll machines have high isentropic and volumetric efficiency, and hence are relatively small and lightweight for a given capacity. They are quieter and more vibration free than many compressors because they do not use large reciprocating components (e.g. pistons, connecting rods, etc.), and because all of the fluid flow is in one direction with simultaneous compression in plural opposed pockets, there are less pressure-created vibrations. Such machines also tend to have high reliability and durability because of the relatively few moving parts utilized, the relative low velocity of movement between the scrolls, and an inherent forgiveness to fluid contamination.

Two types of contacts define the fluid pockets formed between the scroll members: axially extending tangential line contacts between the spiral faces or flanks of the wraps caused by radial forces ("flank sealing"), and area contacts caused by axial forces between the plane edge surfaces (the "tips") of each wrap and the opposite end plate ("tip sealing"). For high efficiency, good sealing must be achieved for both types of contacts, however, the present invention is primarily concerned with flank sealing. A positive flank load is necessary at all operating conditions to prevent scroll flank leakage. Flank load is a function of the operating conditions (i.e. pressure differential), scroll geometry, centrifugal loading and crankshaft "drive angle".

The drive of one popular type of scroll-type apparatus is radially compliant with the crank pin driving a drive bushing via a flat surface on the crank pin which slidingly engages a flat bearing surface disposed on an internal wall in the drive bushing. The bore in the drive bushing is slightly oval in cross-sectional shape to permit relative sliding movement between the crank pin and the drive bushing. While the scroll and crankshaft geometries are normally fixed to provide the minimum flank sealing at the specific operating parameters of a single machine, this scroll apparatus will be penalized when it is required to run at different parameters due to a change in its radial loading producing the flank sealing.

Thus, one of the problem areas of design in a scroll-type machine concerns the techniques used to achieve adequate flank sealing when a single machine is required to run under various operating parameters due to the fact that the scroll and crankshaft geometries for that machine are designed for a single set of parameters. An example of this problem of fixed design is in machines which are required to operate using 60 Hz power sources and those which are required to operate using 50 Hz power sources. If a scroll-type apparatus is designed for a 50 Hz (low speed) application, this apparatus would be penalized when running at 60 Hz (high speed) due to an increase in radial loading of the flanks. The penalties exacted in this case will be increased friction and excessive sound output or noise. If a scroll-type apparatus is designed for a 60 Hz (high speed) application, this apparatus may not achieve sufficient flank sealing when running at 50 Hz (low speed) due to a decrease in radial loading. A typical solution to the 60 Hz/50 Hz problem has been to have two different drive angle crankshaft/drive bushing combinations available for use depending on the specific application. This solution can be achieved by changing the drive bushing configuration and/or by machining variations of the flat on the crank pin of the crankshaft. Either of these solutions require significant additional investment in crankshaft tooling and gaging or in tooling for an additional drive bushing.

The present invention provides the art with a scroll type apparatus having a radial compliant drive. The radial compliant drive is achieved by using a set of corresponding flat drive surfaces with one of the drive surfaces being located on a drive bushing and the other being located on a crankshaft. The drive bushing is provided with a pair of flat drive surfaces with each flat drive surface of the drive bushing being capable of mating with the drive surface of the crankshaft in two different geometrical configurations to provide two different radial driving loads.

Other advantages and objects of the present invention will become apparent to those skilled in the art from the subsequent detailed description, appended claims and drawings.

BRIEF DESCRIPTION OF THE DRAWINGS

In the drawings which illustrate the best mode presently contemplated for carrying out the present invention:

FIG. 2 is a schematic illustration which defines the drive angle of a scroll compressor and illustrates the effect on the drive angle by changing the distance between the flat on the bushing and the bushing center line;

FIG. 3 is a cross-sectional plan view of a crankshaft and a drive bushing defining a first drive angle;

FIG. 4 is a cross-sectional plan view showing the crankshaft shown in FIG. 4 and a different drive bushing defining a second drive angle;

FIG. 5 is a top plan view of the drive bushing shown in FIG. 1 in accordance with the present invention;

FIG. 6*a* is a sectional view taken substantially along line 6—6 in FIG. 1 illustrating the drive bushing and crankshaft at a first drive angle in accordance with the present invention;

FIG. 6*b* is a sectional view similar to FIG. 6*a* but illustrating the drive bushing and crankshaft at a second drive angle in accordance with the present invention;

DETAILED DESCRIPTION OF THE PREFERRED EMBODIMENT

The present invention is suitable for incorporation in many different types of scroll machines. For exemplary purposes it will be described herein incorporated into a hermetic scroll refrigerant motor compressor of the type where the motor and the compressor are cooled by the suction gas within the hermetic shell as illustrated in the vertical section shown in FIG. 1.

Figure 1:
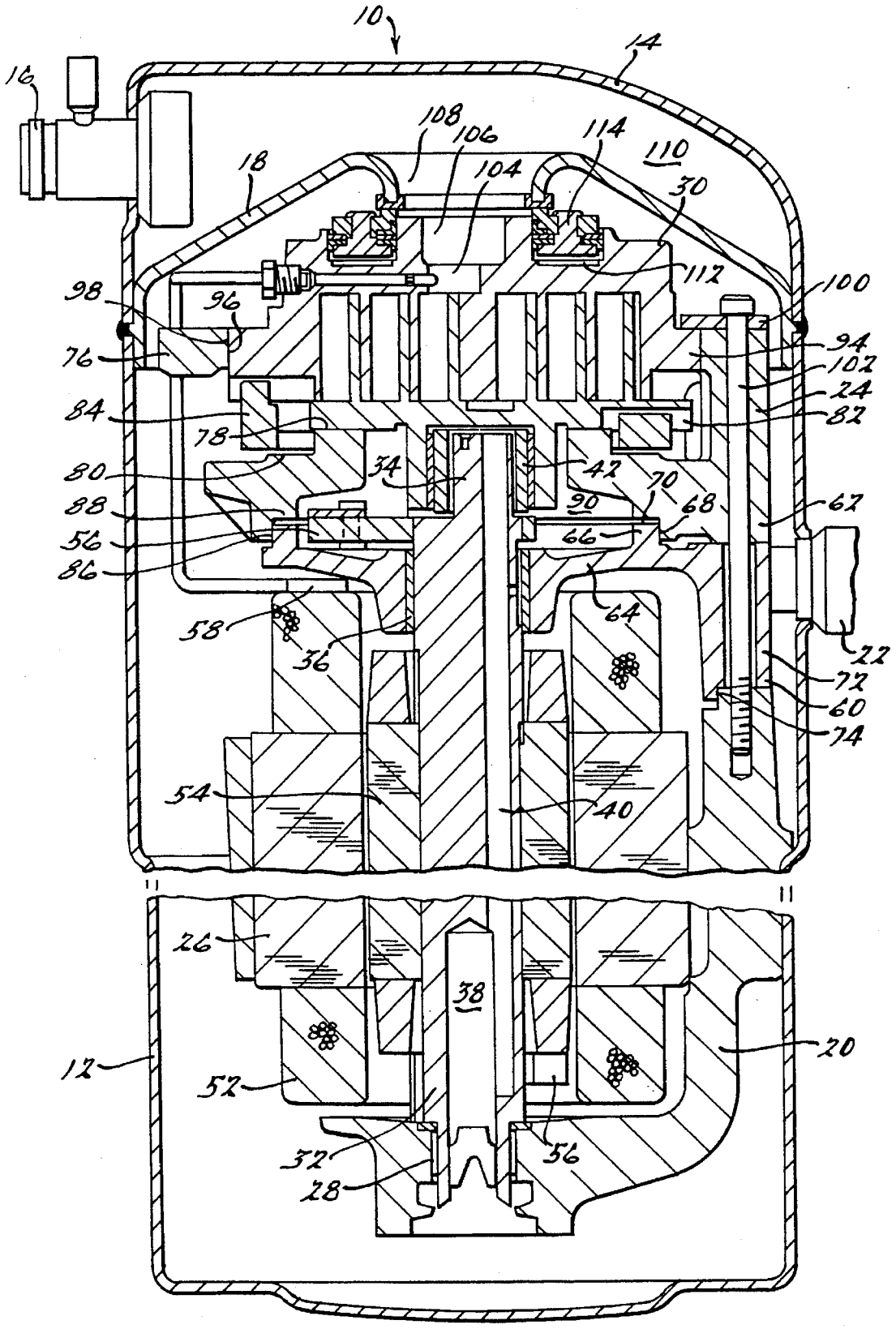
FIG. 1 is a vertical sectional view through a hermetic scroll compressor embodying the principles of the present invention.

Referring now to the drawings in which like reference numerals designate like or corresponding parts throughout the several views, there is shown in FIG. 1, a scroll compressor 10 incorporating the multi-position drive bushing of the present invention. Compressor 10 comprises a cylindrical hermetic shell 12 having welded at the upper end thereof a cap 14. Cap 14 is provided with a refrigerant discharge fitting 16 optionally having the usual discharge valve therein (not shown). Other elements affixed to cylindrical shell 12 include a transversely extending partition 18 which is welded about its periphery at the same point cap 14 is welded to shell 12, a lower bearing housing 20 which is affixed to shell 12 at a plurality of points by methods known well in the art, and a suction gas inlet fitting 22.

Lower bearing housing 20 locates and supports within shell 12 a main bearing housing 24, a motor stator 26, a bearing 28 and a non-orbiting scroll member 30. A crankshaft 32 having an eccentric crank pin 34 at the upper end thereof is rotatably journaled in bearing 28 in lower bearing housing 20 and in a bearing 36 located in main bearing housing 24. Crankshaft 32 has at its lower end the usual relatively large diameter oil pumping concentric bore 38 which communicates with a smaller diameter bore 40 extending upward therefrom to the top of crankshaft 32. The lower portion of cylindrical shell 12 is filled with lubricating oil in the usual manner and the pump at the bottom of crankshaft 32 is the primary pump acting in conjunction with bore 40 to pump lubricating fluid to all the various components of compressor 10 which require lubrication.

The present invention is directed towards a unique multi-position drive bushing 42 as shown in FIGS. 1, 5, 6*a* and 6*b*. Crank pin 34 is formed with a flat driving surface 44 which drivingly engages one of two corresponding flat inner driven surfaces 46 or 48 formed within bushing 42 to provide a radially compliant driving arrangement similar to that shown in assignee's U.S. Pat. No. 5,295,813 entitled "Scroll Compressor Having Flat Driving Surfaces," the disclosure of which is hereby incorporated herein by reference. Crank pin 34 also includes a second flat surface 50 which provides the necessary clearance for the assembly of multi-position drive bushing 42 with crank pin 34. The operation and function of drive bushing 42 in conjunction with crank pin 34 and compressor 10 will be fully described later herein.

Crankshaft 32 is rotatably driven by an electric motor including motor stator 26 having motor windings 52 passing therethrough, and a motor rotor 54 press fit on crankshaft 32 and having one or more counterweights 56. A temperature sensor 58 of the usual type is provided in close proximity to motor windings 52 so that if motor windings 52 exceed a specified operating temperature, sensor 58 will signal a control device (not shown) and de-energize the motor.

Main bearing housing 24 includes a lower portion 60 and an upper portion 62. Lower portion 60 has a generally cylindrical shaped central portion 64 within which the upper end of crankshaft 32 is rotatably supported by means of bearing 36. An upstanding annular projection 66 is provided on lower portion 60 adjacent the outer periphery of central portion 64 and includes an accurately machined radially outwardly facing surface 68 and an axially upwardly facing locating surface 70. A plurality of radially circumferentially spaced supporting arms 72 extend generally radially outwardly from central portion 64 and include depending portions adapted to engage and be supported on lower bearing housing 20. A step 74 is provided on the terminal end of the depending portion of each of the supporting arms 72 which is designed to mate with a corresponding recess provided on the abutting portion of lower bearing housing 20 for aiding in radially positioned lower portion 60 with respect to lower bearing housing 20.

Upper portion 62 of main bearing housing 24 is generally cup-shaped including an upper annular guide ring portion 76 integrally formed therewith, an annular axial thrust bearing surface 78 disposed below ring portion 76 and a second annular supporting bearing surface 80 positioned below and in radially outwardly surrounding relationship to axial thrust bearing surface 78. Axial thrust bearing surface 78 serves to axially movably support an orbiting scroll member 82, and supporting bearing surface 80 provides support for an Oldham coupling 84. The lower end of upper portion 62 includes an annular recess defining radially inwardly and axially downwardly facing surfaces 86, 88 respectively which are designed to mate with surfaces 68 and 70, respectively, of lower portion 60 to aid in axially and radially positioning upper and lower portions 60 and 62 relative to each other. Additionally, a cavity 90 is designed to accommodate rotational movement of counterweight 56 secured to crankshaft 32 at the upper end thereof. The provision of this cavity enables counterweight 56 to be positioned in closer proximity to orbiting scroll member 82 thus enabling the overall size thereof to be reduced.

Annular integrally formed guide ring 76 is positioned in surrounding relationship to a radially outwardly extending flange portion 94 of non-orbiting scroll member 30 and includes a radially inwardly facing surface 96 adapted to slidingly abut a radially outwardly facing surface 98 of flange portion 94 so as to radially position and guide axial movement of non-orbiting scroll member 30. In order to limit the axial movement of non-orbiting scroll member 30 in a direction away from orbiting scroll member 82, a plurality of stop members 100 are provided which are secured to the top surface of annular ring 76 by bolts 102. Each of the stop members 100 includes a radially inwardly extending portion which is adapted to overlie an upper surface of flange portion 94 of non-orbiting scroll member 30 and cooperate therewith to limit axial upward movement of non-orbiting scroll member 30. Bolts 102 also serve to both secure upper and lower portions 60 and 62 of main bearing assembly together as well as to secure this assembly to lower bearing housing 20. It should also be noted that the axial positioning of stop member 100 will be accurately controlled relative to the corresponding opposed surface of flange portion 94 to allow slight limited axial movement of non-orbiting scroll member 30. The scroll compressor as thus far described with the exception of multi-position drive bushing 42 is further detailed in assignee's copending application Ser. No. 863,949 entitled "Non-Orbiting Scroll Mounting Arrangements for a Scroll Machine," filed Apr. 6, 1992, the disclosure of which is hereby incorporated by reference.

Non-orbiting scroll member 30 has a centrally disposed discharge passageway 104 communicating with an upwardly open recess 106 which is in fluid communication via an opening 108 in partition 18 with a discharge muffler chamber 110 defined by cap 14 and partition 18. Non-orbiting scroll member 30 has in the upper surface thereof an annular recess 112 having parallel coaxial side walls in which is sealingly disposed for relative axial movement an annual floating seal 114 which serves to isolate the bottom of recess 112 from the presence of gas under suction and discharge pressure so that it can be placed in fluid communication with a source of intermediate fluid pressure by means of a passageway (not shown). Non-orbiting scroll member 30 is thus axially biased against orbiting scroll member 82 by the forces created by discharge pressure acting on the central portion of non-orbiting scroll member 30 and those created by intermediate fluid pressure acting on the bottom of recess 112. This axial pressure biasing, as well as other various techniques for supporting scroll member 30 for limited axial movement are disclosed in much greater detail in assignee's U.S. Pat. No 4,877,382, the disclosure of which is hereby incorporated by reference.

Relative rotation of the scroll members is preferably prevented by the usual Oldham coupling 84 of the type disclosed in the above referenced U.S. Pat. No. 4,877,382, however, the coupling disclosed in assignee's U.S. Pat. No. 5,320,506, the disclosure of which is hereby incorporated by reference, may be used in place thereof.

The compressor is preferably of the "low side" type in which suction gas entering via gas inlet fitting 22 is allowed, in part, to escape into shell 12 and assist in cooling the motor. So long as there is an adequate flow of returning suction gas the motor will remain within desired temperature limits. When this flow drops significantly, however, the loss of cooling will eventually cause temperature sensor or sensors 58 to signal the control device and shut the machine down.

The scroll compressor as thus far broadly described with the exception of multi-position drive bushing 42 is either now known in the art or is subject matter of other pending applications for patent by applicant's assignee. The details of construction which incorporate the principles of the present invention are those which deal with unique multi-position drive bushing 42.

FIG. 2 schematically illustrates what is known as the "drive angle". Rotation of crankshaft 32 causes drive bushing 42 to rotate about the axis of crankshaft 32. This, in turn, causes scroll member 82 to move in a circular orbital path. The drive angle is chosen so that the drive introduces a radial flank load component that is nominally proportional to the drive load in order to enhance flank sealing between scroll members 82 and 30. FIG. 2, illustrates a crankshaft 120 having a center or axis of rotation 122 and a crank pin 124. Crank pin 124 includes a flat driving surface 126 which engages a flat driven surface 128 on a drive bushing 130 having a center 132. The drive angle is shown as angle 134 and is defined as the angle between surfaces 126 and 128 and a line connecting centers 122 and 132. Angle 134 can be changed by altering various parameters. One method of changing angle 134 is to change the distance between driven surface 128 and center 132. This is shown in phantom in FIG. 2 where the distance is reduced as illustrated by center **132*a* and drive bushing 130*a*. The new drive angle 134*a*** results in a change to the amount of radial force introduced to the orbiting scroll. Thus, by changing the distance between the center of the drive bushing and the distance to the driven surface of the drive bushing, the radial force introduced to the orbiting scroll can be adjusted. This adjustment in the radial force is caused by a change in the drive angle.

FIGS. 3 and 4 illustrate this concept in greater detail. FIG. 3 illustrates a crankshaft 140 having a center or axis of rotation 142 and a crank pin 144. Crank pin 144 includes a flat driving surface 146 which engages a flat driven surface 148 on a drive bushing 150 having a center 152. The distance between center 152 and driven surface 148 is shown as $D_1$ and this combination produces a drive angle 154. FIG. 4 illustrates crankshaft 140 having center 142 and crank pin 144. Crank pin 144 includes flat driving surface 146 which engages a flat driven surface 158 on a drive bushing 160 having a center 162. The distance between center 162 and driven surface 158 is shown as $D_2$ ($D_2$ being slightly greater than $D_1$). This combination produces a drive angle 164 which is less than drive angle 154 and this difference in drive angle will change the radial force introduced to the orbiting scroll.

The present invention incorporates the above concept by providing drive bushing 42 with flat inner driven surfaces 46 and 48 as shown in FIG. 5. Driven surface 46 is located distance $D_1$ from the center of drive bushing 42 while driven surface 48 is located distance $D_2$ from the center of drive bushing 42. The two flat inner driven surfaces 46 and 48 thus provide multi-position drive bushing 42 with the ability to be designed to introduce two separate and different radial loads into scroll member 82 depending on which driven surface 46 or 48, is engaged with driving surface 44 on crank pin 34. This multi-position provision of drive bushing 42 is especially beneficial when compressor 10 is being built to operate in either a 50 Hz electrical system or a 60 Hz electrical system. Prior art compressors required a change to the crankshaft and/or the drive bushing to accommodate the specific 50 Hz or 60 Hz system. This was due to the fact that the compressor runs slower in the 50 Hz system. Thus, two sets of tooling were required as well as the internal complications and costs involved in maintaining two sets of compressor components. The present invention avoids these complications by allowing the manufacturer to simply locate drive bushing 42 in the appropriate position to accommodate either the 50 Hz for the 60 Hz electrical system.

FIGS. 6*a* and 6*b* illustrate the multi-position capabilities of drive bushing 42. FIG. 6*a* illustrates crankshaft 32 having a center or axis of rotation 180 and crank pin 34. Crank pin 34 includes flat driving surface 44 which is in engagement with flat driven surface 46 of drive bushing 42 having a center 182. The distance between center 182 and driven surface 46 is $D_1$ and this combination produces a drive angle 184. FIG. 6*b* illustrates crankshaft 32 with center 180 and crank pin 34. Crank pin 34 includes flat driving surface 44 which is engagement with flat driven surface 48 of drive bushing 42 due to the 180° rotation of drive bushing 42. The distance between center 182 of drive bushing 42 and driven surface 48 is $D_2$ and this combination produces a drive angle 186 which is less than drive angle 184. This difference in drive angle will change the radial forces introduced to orbiting scroll member 82 during the operation of compressor 10. As stated above, this multi-position provision of drive bushing 42 is especially beneficial when compressor 10 is being built to operate in both a 50 Hz electrical system and a 60 Hz electrical system.

Figure 7:
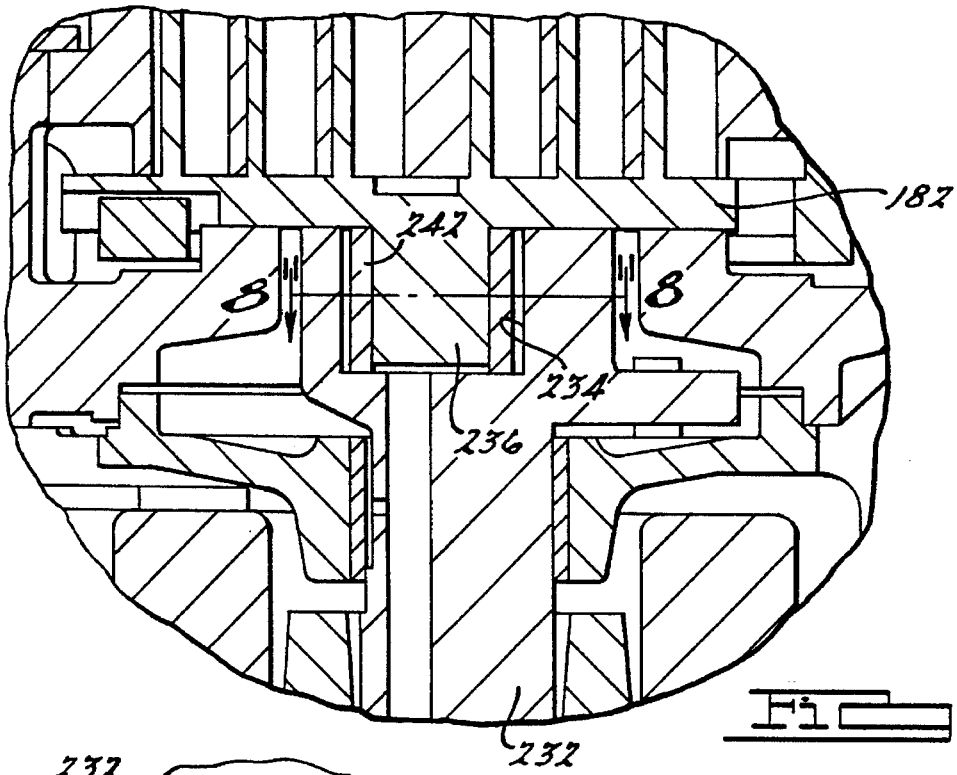
FIG. 7 is a side elevational view in cross-section of the interface between the crankshaft and the orbiting scroll in accordance with another embodiment of the present invention.
Figure 8A:
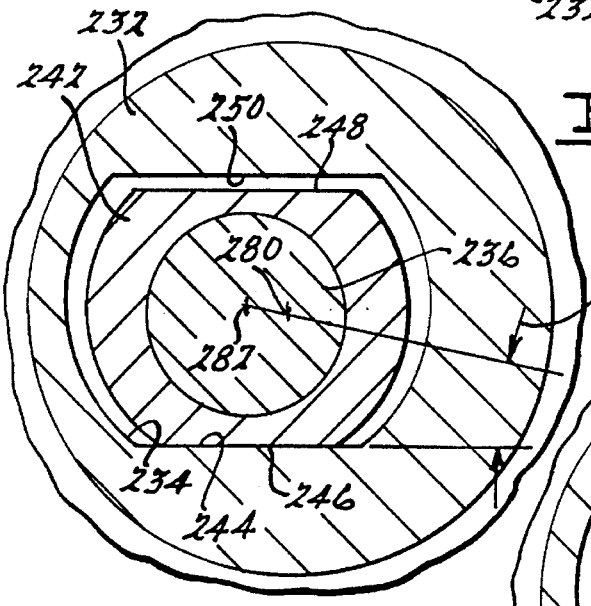
FIG. 8*a* is a sectional view taken substantially along line 8—8 in FIG. 7 illustrating the drive bushing and crankshaft at a first drive angle.
Figure 8B:
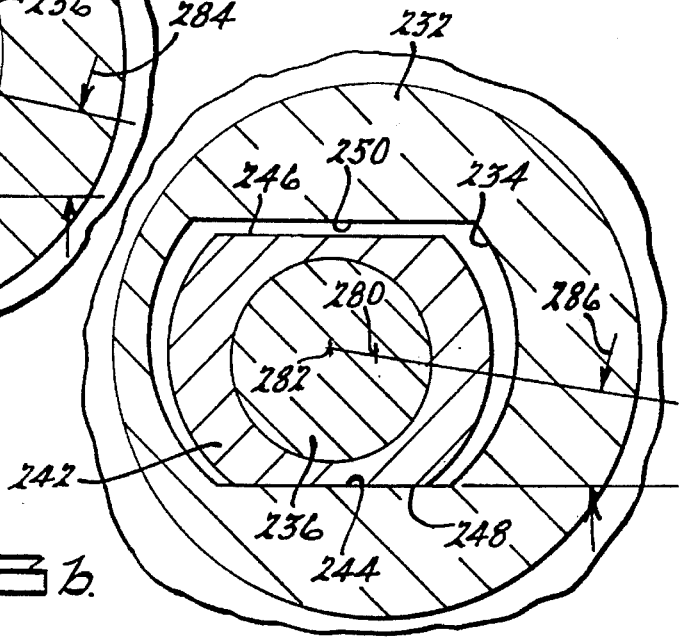
FIG. 8*b* is a sectional view similar to FIG. 8*a* but illustrating the drive bushing and crankshaft at a second drive angle in accordance with the present invention.

FIGS. 7, 8*a* and 8*b* illustrate a compliant drive for a scroll machine in accordance with another embodiment of the present invention. Hermetic scroll compressor 10 shown in FIGS. 1, 5, 6*a* and 6*b* includes crankshaft 32 having an eccentric crank pin 34 which is formed with flat driving surface 44 which drivingly engages one of two corresponding flat inner driven surfaces 46 or 48 formed within bushing 42 to provide the radially compliant driving arrangement. Bushing 42 is disposed between crank pin 32 and orbiting scroll member 82 in a bore formed by orbiting scroll member 82.

The embodiment of the present invention illustrated in FIGS. 7, 8*a* and 8*b* is opposite to the above described system. FIG. 7 illustrates a crankshaft 232 having an eccentric bore 234 within which a multi-position bushing 242 and a drive pin 236 of an orbiting scroll 182 are disposed. Eccentric bore 234 is formed with a flat driving surface 244 which drivingly engage one of two corresponding flat driven surfaces 246 or 248 formed on bushing 242 to provide a radially compliant driving arrangement. Eccentric bore 234 also includes a second flat surface 250 which reduces the clearance between bore 234 and multi-position bushing 242 to limit the movement between the two components. The motor and compressor associated with the embodiment of the radially compliant drive system shown in FIGS. 7, 8*a* and 8*b* is identical to that described above for FIGS. 1, 5, 6*a* and 6*b* with the exception of the operation and function of drive bushing 242 in conjunction with eccentric bore 234.

FIGS. 8*a* and 8*b* illustrate the multi-position capabilities of drive bushing 242. FIG. 8*a* illustrates crankshaft 232 having a center or axis of rotation 280 and eccentric bore 234. Eccentric bore 234 includes flat driving surface 244 which is in engagement with flat driven surface 246 of drive bushing 242 having a drive bushing center 282. The distance between drive bushing center 282 and driven surface 246 is $D_3$ and this combination produces a drive angle 284. FIG. 8*b* illustrates crankshaft 232 with center 280 and eccentric bore 234. Eccentric bore 234 includes flat driving surface 244 which is engagement with flat driven surface 248 of drive bushing 242 due to the 180° rotation of drive bushing 242. The distance between center 282 of drive bushing 242 and driven surface 248 is $D_4$ and this combination produces a drive angle 286 which is less than drive angle 284. This difference in the drive angle will change the radial forces introduced to orbiting scroll member 282 during the operation of the compressor. As stated above, this multi-position provision of drive bushing 242 is especially beneficial when the compressor is being built to operate in both a 50 Hz electrical system and a 60 Hz electrical system.

While the above detailed description describes the preferred embodiment of the present invention, it should be understood that the present invention is susceptible to modification, variation and alteration without deviating from the scope and fair meaning of the subjoined claims.

What is claimed is:

1. A motor-compressor assembly comprising:

a shell;

first and second scroll members disposed in said shell, each of said scroll members having a spiral wrap thereon, said scroll members facing one another with said wraps inter-meshed with one another so that orbiting movement of said first scroll member with respect to said second scroll member will cause said wraps to create pockets of progressively decreasing volume towards the center of said scrolls;

a crankshaft defining a crankshaft axis drivingly engaging said first scroll member to cause said orbiting movement of said first scroll member, said crankshaft including a crank pin having a flat driving surface;

a motor disposed in said shell and connected to said crankshaft to power same; and a drive bushing defining a bushing axis and having first and second surfaces capable of being driven by said flat driving surface, said bushing being disposed between said crank pin and said first scroll member, said drive bushing and said crankshaft forming a drive angle defined as the angle between said flat driving surface and a line connecting said crankshaft axis and said bushing axis, said drive bushing being selectively assembled between a first position wherein said bushing axis is located a first distance from said flat driving surface when said flat driving surface is in engagement with said first bushing surface such that said drive angle produces a first radial flank load component due to said motor powering said crankshaft in a forward direction and a second position wherein said bushing axis is located a second distance from said flat driving surface when said flat driving surface is in engagement with said second bushing surface such that said drive angle produces a second radial flank load component due to said motor powering said crankshaft in said forward direction, said first distance being different from said second distance such that said second radial flank load is different than said first radial flank load.

2. The motor-compressor assembly according to claim 1 wherein, said orbiting movement of said first scroll member introduces centrifugal forces on said first scroll member, said first radial flank load component being additive to said centrifugal forces.

3. The motor-compressor assembly according to claim 2 wherein, said second radial flank load component is additive to said centrifugal forces.

4. The motor-compressor assembly according to claim 1 wherein, said drive bushing defines a first and a second generally flat driven surface.

5. The motor-compressor assembly according to claim 4 wherein, said flat driving surface drivingly engages one of said first and second generally flat driven surfaces.

6. The motor-compressor assembly according to claim 5 wherein, said driving surface and said one driven surface can slide relative to one another to accommodate limited radial unloading of said scroll members.

7. The motor compressor assembly according to claim 4 wherein, said flat driving surface drivingly engages said first driven surface to produce said first radial flank component.

8. The motor-compressor assembly according to claim 7 wherein, said orbiting movement of said first scroll member introduces centrifugal forces on said first scroll member, said first radial flank load component being additive to said centrifugal forces.

9. The motor-compressor assembly according to claim 7 wherein, said driving surface and said first driven surface can slide relative to one another to accommodate radial unloading of said scroll members.

10. The motor-compressor assembly according to claim 4 wherein, said flat driving surface drivingly engages said second driven surface to produce said second radial flank component.

11. The motor-compressor assembly according to claim 10 wherein, said orbiting movement of said first scroll member introduces centrifugal forces on said first scroll member, said second radial flank load component being additive to said centrifugal forces.

12. The motor-compressor assembly according to claim 10 wherein, said driving surface and said second driven surface can slide relative to one another to accommodate radial unloading of said scroll members.

13. The motor-compressor assembly according to claim 1 wherein, said bushing can slide relative to said crank pin to accommodate limited radial unloading of said scroll members.

14. A motor-compressor assembly comprising:

a shell first and second scroll members disposed in said shell, each of said scroll members having a spiral wrap thereon, said scroll members facing one another with said wraps inter-meshed with one another so that orbiting movement of said first scroll member with respect to said second scroll member will cause said wraps to create pockets of progressively decreasing volume towards the center of said scrolls;

a hub disposed on the axially opposite side of said first scroll member from said spiral wrap, said hub defining a central bore;

a crankshaft defining a crankshaft axis and having an eccentric crank pin disposed in said central bore, said crank pin having a flat driving surface and drivingly engaging said first scroll member to cause said orbiting movement of said first scroll member;

a motor disposed in said shell and connected to said crankshaft to power same; and a drive bushing defining a bushing axis and having first and second surfaces capable of being driven by said flat driving surface, said bushing being disposed between said crank pin and said first scroll member, said drive bushing and said crankshaft forming a drive angle defined as the angle between said flat driving surface and a line connecting said crankshaft axis end said bushing axis, said drive bushing being selectively assembled between a first position wherein said bushing axis is located a first distance from said flat driving surface when said flat driving surface is in engagement with said first bushing surface such that said drive angle produces a first radial flank load component due to said motor powering said crankshaft in a forward direction and a second position wherein said bushing axis is located a second distance from said flat driving surface when said flat driving surface is in engagement with said second bushing surface such that said drive angle produces a second radial flank load component due to said motor powering said crankshaft in said forward direction, said first distance being different from said second distance such that said second radial flank load is different than said first radial flank load.

15. The motor-compressor assembly according to claim 14 wherein, said orbiting movement of said first scroll member introduces centrifugal forces on said first scroll member, said first radial flank load component being additive to said centrifugal forces.

16. The motor-compressor assembly according to claim 15 wherein, said second radial flank load component is additive to said centrifugal forces.

17. The motor-compressor assembly according to claim 14, wherein, said drive bushing defines a first and a second generally flat driven surface.

18. The motor-compressor assembly according to claim 17 wherein, said flat driving surface drivingly engages one of said first and second generally flat driven surfaces.

19. The motor-compressor assembly according to claim 18 wherein, said driving surface and said one driven surface can slide relative to one another to accommodate limited radial unloading of said scroll members.

20. The motor compressor assembly according to claim 17 wherein, said flat driving surface drivingly engages said first driven surface to produce said first radial flank component.

21. The motor-compressor assembly according to claim 20 wherein, said orbiting movement of said first scroll member introduces centrifugal forces on said first scroll member, said first radial flank load component being additive to said centrifugal forces.

22. The motor-compressor assembly according to claim 20 wherein, said driving surface and said first driven surface can slide relative to one another to accommodate radial unloading of said scroll members.

23. The motor-compressor assembly according to claim 17 wherein, said flat driving surface drivingly engages said second driven surface to produce said second radial flank component.

24. The motor-compressor assembly according to claim 23 wherein, said orbiting movement of said first scroll member introduces centrifugal forces on said first scroll member, said second radial flank load component being additive to said centrifugal forces.

25. The motor-compressor assembly according to claim 23 wherein, said driving surface and said second driven surface can slide relative to one another to accommodate radial unloading of said scroll members.

26. The motor-compressor assembly according to claim 14 wherein, said bushing can slide relative to said crank pin to accommodate limited radial unloading of said scroll members.

27. A motor-compressor assembly comprising:

a shell;

first and second scroll members disposed in said shell, each of said scroll members having a spiral wrap thereon, said scroll members facing one another with said wraps inter-meshed with one another so that orbiting movement of said first scroll member with respect to said second scroll member will cause said wraps to create pockets of progressively decreasing volume towards the center of said scrolls;

a hub disposed on the axially opposite side of said first scroll member from said spiral wrap;

a crankshaft defining an eccentric bore with a flat driving surface and a crankshaft axis, said hub of said first scroll member being disposed within said eccentric bore, said crankshaft drivingly engaging said hub to cause said orbiting movement of said first scroll member;

a motor disposed in said shell and connected to said crankshaft to power same; and a drive bushing defining a bushing axis and having first and second surfaces capable of being driven by said flat driving surface, said bushing being disposed within said eccentric bore between said crankshaft and said hub of said first scroll member, said drive bushing and said crankshaft forming a drive angle defined as the angle between said flat driving surface and a line connecting said crankshaft axis and said bushing axis, said drive bushing being selectively assembled between a first position wherein said bushing axis is located a first distance from said flat driving surface when said flat driving surface is in engagement with said first bushing surface such that said drive angle produces a first radial flank load component due to said motor powering said crankshaft in a forward direction and a second position wherein said bushing axis is located a second distance from said flat driving surface when said flat driving surface is in engagement with said second bushing surface such that said drive angle produces a second radial flank load component due to said motor powering said crankshaft in said forward direction, said first distance being different from said second distance such that said second radial flank load is different than said first radial flank load.

28. The motor-compressor assembly according to claim 27 wherein, said orbiting movement of said first scroll member introduces centrifugal forces on said first scroll member, said first radial flank load component being additive to said centrifugal forces.

29. The motor-compressor assembly according to claim 28 wherein, said second radial flank load component is additive to said centrifugal forces.

30. The motor-compressor assembly according to claim 27 wherein, said annular drive bushing defines a first and a second generally flat driven surface.

31. The motor-compressor assembly according to claim 30 wherein, said flat driving surface drivingly engages one of said first and second generally flat driven surfaces.

32. The motor-compressor assembly according to claim 31 wherein, said driving surface and said one driven surface can slide relative to one another to accommodate limited radial unloading of said scroll members.

33. The motor compressor assembly according to claim 30 wherein, said flat driving surface drivingly engages said first driven surface to produce said first radial flank component.

34. The motor-compressor assembly according to claim 33 wherein, said orbiting movement of said first scroll member introduces centrifugal forces on said first scroll member, said first radial flank load component being additive to said centrifugal forces.

35. The motor-compressor assembly according to claim 33 wherein, said driving surface and said first driven surface can slide relative to one another to accommodate radial unloading of said scroll members.

36. The motor-compressor assembly according to claim 30 wherein, said flat driving surface drivingly engages said second driven surface to produce said second radial flank component.

37. The motor-compressor assembly according to claim 36 wherein, said orbiting movement of said first scroll member introduces centrifugal forces on said first scroll member, said second radial flank load component being additive to said centrifugal forces.

38. The motor-compressor assembly according to claim 36 wherein, said driving surface and said second driven surface can slide relative to one another to accommodate radial unloading of said scroll members.

39. The motor-compressor assembly according to claim 27 wherein, said bushing can slide relative to said crank pin to accommodate limited radial unloading of said scroll members.

* * * * *